US005378600A

United States Patent [19]

Goan

[11] Patent Number: 5,378,600

[45] Date of Patent: Jan. 3, 1995

[54] METHOD OF MANUFACTURING SILVER HALIDE PHOTOGRAPHIC EMULSION

[75] Inventor: Kazuyoshi Goan, Hino, Japan

[73] Assignee: Konica Corporation, Tokyo, Japan

[21] Appl. No.: 148,692

[22] Filed: Nov. 5, 1993

[30] Foreign Application Priority Data

Nov. 10, 1992 [JP] Japan ..... 4-299875

[51] Int. Cl.[6] ..... G03C 1/015

[52] U.S. Cl. ..... 430/569; 430/567

[58] Field of Search ..... 430/567, 569

[56] References Cited

U.S. PATENT DOCUMENTS 4,301,241 11/1981 Saito ..... 430/569

5,204,235 4/1993 Yamamoto et al. ..... 430/569

FOREIGN PATENT DOCUMENTS 0346122 12/1989 European Pat. Off. .

0462543 12/1991 European Pat. Off. .

0492519 7/1992 European Pat. Off. .

*Primary Examiner*—Charles L. Bowers, Jr.

*Assistant Examiner*—Mark F. Huff

*Attorney, Agent, or Firm*—Frishauf, Holtz, Goodman & Woodward

[57] ABSTRACT

A method for preparing a silver iodobromide emulsion comprising silver iodobromide grains containing an average silver iodide content of 2 mol % or less is provided, wherein the silver iodobromide emulsion is prepared by incorporating simultaneously a silver salt solution and a solution of bromide and iodide salts into a hydrophilic colloid solution containing silver halide seed grains to grow the silver iodobromide grains from the seed grains, wherein the total volume of the solutions of the silver salt and the bromide and iodide salts is within a range of 2 to 10 times the volume of the hydrophilic colloid solution containing the seed grains in an amount of 0.5 to 5.0% by volume.

14 Claims, No Drawings

METHOD OF MANUFACTURING SILVER HALIDE PHOTOGRAPHIC EMULSION

FIELD OF THE INVENTION

The present invention relates to a method of manufacturing silver halide photographic emulsion. More specifically, the present invention relates to a method of manufacturing silver halide photographic emulsion having high sensitivity and low fog, and improved in pressure resistance and graininess.

BACKGROUND OF THE INVENTION

Recently, due to rapid development in the photographic technology, development and realization of silver halide light-sensitive photographic materials which have higher sensitivity and image quality and which are adaptable to rapid process has strongly been demanded.

For instance, in the field of radiology and X-ray light-sensitive photographic materials for medical use, with the increase in the chances of medical examination, items of medical inspections and the number of chances of shooting pictures have also increased. And, because of necessity for doctors to know the results of inspections as soon as possible, improved rapid-processability of the light-sensitive photographic materials becomes a stronger demand than ever before.

Particularly, pictures of arteriography or those taken during an operation require images of higher image quality as quickly as possible.

To answer the demand mentioned above, a light-sensitive material which comprises tabular-shape silver halide grains has recently been proposed.

The tabular-shaped silver halide grain, because of its relatively large specific surface area, can adsorb a large quantity of a spectral sensitizing dye. Therefore, in addition to improvements in spectral sensitization, the photographic material comprising tabular grains has an advantage that not only high sensitivity and high image sharpness may easily be obtained but also crossover light through the light-sensitive material can be reduced.

However, in general, tabular grains with a large diameter-thickness ratio have a disadvantage that they are weak against external force because of their shape. Therefore, for instance, when the light-sensitive material is folded while it is handled, or when mechanical stress is added to it during transportation, bends tend to be caused. And as the result thereof serious defects such a blackening like a streak, fogging by the pressure and desensitization are likely to take place, which can be a serious problem in the case of photographic materials for diagnostic use.

Two methods have been proposed as a means for preventing sensitivity from the pressure.

One method is physically to relax the stress acted on the silver halide grain when an external pressure is applied to photographic material.

Another method is to decrease pressure sensitivity of the silver halide crystal itself.

As the approach of the former, for example, there have been disclosed methods for covering the crystal surface by using gelatin, a hydrophilic polymer or a latex as a binder of an emulsion layer, or incorporating a gelatin plasticizer or a substance adsorbable to silver halide grains.

However, these methods result in a slow down of the speed of development and drying. This is against the current demand and is undesirable.

As the latter approach from silver halide crystal, for example, a method of providing a high silver iodide-containing layer inside the tabular grain as disclosed in Japanese Patent O.P.I. Publication No. 59-99433 (1984) for the purpose of improving pressure resistance, or a method disclosed in Japanese Patent O.P.I. Publication No. 61-14636 (1986), etc., in which pressure resistance may be improved by raising the silver iodide content in the central portion of the tabular grains more than that of the outer portion, etc. are known.

However, according to the latter method, although some improvement in the pressure resistance may be recognized, a remarkable deterioration in developability is induced, and, for example, when the average silver iodide content of the entire grains is lowered, development speed tends to exceed and, as a result, a problem of deterioration in the graininess arises.

Since deterioration of the graininess in the photographic light-sensitive material, especially in the x-ray images, can lead to a wrong diagnosis, a method which has a strong effect on the developability of the photographic material is undesirable and a new countermeasure against this has been demanded.

SUMMARY OF THE INVENTION

Therefore, the object of the present invention is to provide a method of manufacturing silver halide photographic emulsion, with which silver halide light-sensitive photographic materials having high sensitivity, giving a high image quality and having improved anti-pressure property without deteriorating graininess, is obtained.

The inventors have found that the above-mentioned object of the present invention can be achieved by the following method. In a method of manufacturing a silver iodobromide emulsion comprising silver iodobromide grains containing not more than 2.0 mol % of silver iodide, said emulsion is prepared, in a reaction vessel having a hydrophilic colloid solution containing silver halide seed grains previously-prepared, by simultaneously mixing a solution of a soluble silver salt and a solution of a soluble halide. Furthermore, the preparation of said emulsion is conducted under the following conditions (1) and (2):

(1) The total volume of the solutions of a soluble silver salt and a soluble halide salt to be incorporated into the reaction vessel is within a range of 2 to 10 times the volume of the hydrophilic colloid solution containing the silver halide seed grains in the reaction vessel; and (2) The volume concentration of the seed grains in the hydrophilic colloid solution which contains the seed grain in the reaction vessel is from 0.5 to 5.0% of the volume of the hydrophilic colloid solution.

DETAILED DESCRIPTION OF THE INVENTION

Silver iodobromide emulsion prepared according to the present invention compresses silver iodobromide grains containing silver iodide in an amount of 2.0 mol % or less and, preferably, 2.0–0.05 mol %.

Halide distribution within the silver halide grain according to the present invention may be uniform composition or nonuniform composition with difference between inner and outer portions, which consist of layered structure (core/shell structure).

According the present invention, the silver halide grain emulsion is prepared by using silver halide emulsion prepared beforehand as a seed emulsion, from which the grains are further grown.

The silver halide emulsion of the present invention may be prepared by an acidic process, a neutral process or an ammoniacal process.

A simultaneous double-jet mixing process (double jet method) is used for reaction of a soluble silver salt (for instance, aqueous silver nitrate solution or ammoniacal silver nitrate solution) with a soluble halide (for instance, aqueous solutions of such as KBr or KI).

As one embodiment of the double jet mixing process, there can be employed controlled double jet mixing process, in which pAg of the liquid phase is kept constant, thereby silver halide emulsion grains with a regular crystal shape and uniform size distribution being obtained.

In the double-jet mixing process of the present invention, the total amount of soluble silver salt and soluble halide solutions to be introduced into the reaction vessel is from 2 to 10 times and, preferably, from 2 to 5 times as much as that of hydrophilic colloidal solution in the reaction vessel which contains the silver halide seed grains.

The volume concentration of the seed grains in the hydrophilic colloidal solution in the reaction vessel is in the range of 0.5% to 5.0% and, preferably 0.6% to 3.0% by volume. The volume concentration of the seed grains mentioned herein is defined by the following formula:

Volume concentration of seed grains = Total volume of seed grains × 100/Volume of hydrophilic colloidal solution where the total volume of seed grains is defined as the product of an average volume of the seed grain and number of the seed grains.

The seed grains have an average grain size of not more than 0.3 μm and preferably, 0.1 to 0.25 μm. The grain size mentioned herein refers to an sphere-equivalent diameter of the grain. Thus, the average grain size of the seed grains is defined as the average diameter when the volume of the seed grain is converted into a sphere having an equivalent volume.

It is preferable that the silver halide emulsion of the present invention is monodispersed, having the distribution width (or coefficient of variation) of not more than 30% and preferably, not more than 20%, defined by the following formula.

Distribution width (%) = (Standard deviation of grain size distribution) × 100/Average Grain Size The crystal shape of the silver halide grain used in the present invention may be optional and it may be either tabular or spherical.

It is preferable that the silver halide emulsion of the invention comprises monodispersed tabular twin crystal grains having an average thickness of not more than 0.3 microns and the average ratio of the diameter of the grain to the thickness thereof of not less than 2, more preferably, the thickness of not more than 0.2 microns and the ratio of 5 to 8, and accounting for not less than 50% of the total projected area of the silver halide grains.

The diameter herein mentioned refers to a circular-equivalent diameter, which is defined as the diameter when the projection image of the grain is converted into a circle having the equivalent area. The thickness of the grain is defined as the distance between two principal surface planes of the tabular grain which opposes each other. The projected area of the grains can be obtained from the sum of the area of the grains. The projected area of the grains is determined by magnifying to 10,000 times–50,000 times, with electron microscope, the silver halide crystal sample distributed on the sample stand so that the grains do not overlap with each other, photographing and measuring the diameter or projected area of the grains. Number of grains measured is to be indiscriminately accounted for 1000 or more.

The thickness of the grain is determined by observing the sample, in the oblique direction, with electron microscope.

In the silver halide emulsion of the present invention, various types of hydrophilic colloids are used as a binder to envelop the silver halide grains. For this purpose, various conventional photographic binders such as, for example, gelatin, a synthetic polymer such as polyvinyl alcohol and polyacrylic amide, colloidal albumin, a polysuccharide, a cellulose derivative may be used.

The silver halide photographic emulsion of the present invention can be prepared by conventional methods. The silver halide photographic emulsion of the present invention can be prepared, for example, by a method described on pages 22 and 23 of the Research Disclosure No. 17643, published in December, 1978, under the title of "Emulsion Preparation and Types"; a method described on page 648 of the Research Disclosure No. 18716 published in November 1979; a method described on pages 38 through 104 of "The Theory of the Photographic Process" Vol. 4, written by T. H. James and published by Macmillan Co.; a method described on pages 38 through 104 of "Photographic Emulsion Chemistry" written by G. F. Duffin, published by Focal Press in 1966; a method described in "Chimie et Physique Photographique" written by Glafkides, published by Paul Montel Co. in 1967; a method described in "Making and Coating Photographic Emulsion" written by V. L. Zelikman et.al. and published by Focal Press Co. in 1964;

In order to remove soluble salts, the emulsion may be washed by noodle washing method, the flocculation method, etc.

As a preferable desalting method, for example, Japanese Patent Publication No. 35-16086 (1960) discloses the use of an aromatic hydrocarbon type aldehyde resin which contains a sulfo group; Japanese Patent O.P.I. Publication No. 63-158644 (1988) discloses a desalting method, in which a high molecular flocculating agent such as those compounds exemplified as G-3, G-4, etc. is used.

In the silver halide photographic light-sensitive material comprising the silver halide photographic emulsion prepared according to the method of the present invention, various photographic additives may be used in the steps before or after physical ripening or chemical ripening steps of the emulsion.

As the compounds which can be used at these steps, for example, those compounds disclosed in the above-mentioned Research Disclosures No. 17643, 18716 and 308119 (December 1989) may be employed. The compounds disclosed in these three documents are given below:

| Additives | RD-17643 Page | RD-17643 Class | RD-18716 Page | RD-308119 Page | RD-308119 Class |
|---|---|---|---|---|---|
| Chemical Sensitizer | 23 | III | 648 | 996 | III |
| Sensitizing Dye | 23 | IV | 648–649 | 996–8 | IV |
| Desensitizing Dye | 23 | IV | | 998 | B |
| Dye | 25–26 | VIII | 649–650 | 1003 | VIII |
| Development Accelerator | 29 | XXI | 648 | | |
| Anti-Foggant, Sstabilizer | 24 | IV | 649 | 1006–7 | VI |
| Whitening Agent | 24 | V | | 998 | V |
| Hardener | 26 | X | 651 | 1004–5 | X |
| Surfactant | 26–27 | XI | 650 | 1005–6 | XI |
| Plasticizer | 27 | XII | 650 | 1006 | XII |
| Lubricant | 27 | XII | | | |
| Matting Agent | 28 | XVI | 650 | 1008–9 | XVI |
| Binder | 28 | XXII | | 1003–4 | IX |
| Support | 29 | XVII | | 1009 | XVII |

As a support which can be used for the silver halide light-sensitive photographic material of the present invention, those described in the above-mentioned Research Disclosure can be given. Support which can be advantageously used for the light-sensitive photographic material is a plastic film. The surface of the support may be provided with a subbing layer, or treated with corona discharge or ultraviolet-ray irradiation for the purpose of improving adhesion property of coating layer.

The light-sensitive material of the present invention can be processed with a processing solution disclosed, for example, on pages 29 and 30, XX–XXI of Research Disclosure No. 17643; on pages 1011 and 1012, XX–XXI of Research Disclosure No. 308119.

A developing agent used in black and white photography is dihydroxy benzene compounds such as hydroquinone, 3-pyrazolidones such as 1-phenyl-3-pyrazolidone and aminophenols such as N-methyl-P-aminophenol, which can be used either singly or in combination thereof. Other known additives, if necessary, such as an alkaline, a pH buffer, an anti-foggant, a hardener, a development accelerator, a surfactant, an anti-foaming agent, an image toner, a water softening agent, a dissolution aid, a viscosity increasing agent may be used in the developing solution.

In the fixing solution, a fixing agent such as thiosulfate or thiocyanate is used.

Further, a water-soluble aluminum salt such as aluminium sulfate or a potassium alum, etc. can be used as a hardener.

Also, the fixing solution may contain a preservatives, a pH adjusting agent, or a water softening agent. Hereinafter, the present invention is furthermore explained with reference to the examples; however, the scope of the present invention is not limited by these.

Example 1

1) Preparation of a seed emulsion

A seed emulsion containing silver halide hexagonal tabular seed grains was prepared in the following method:

| | |
|---|---|
| <Solution A> | |
| Ossein gelatin | 60.2 g |
| Distilled water | 20 l |
| Poly iso-propylene-polyethylene oxy-disuccinic acid ester sodium salt (10% aqueous ethanol solution) | 5.6 ml |

-continued

| | |
|---|---|
| Potassium bromide | 26.8 g |
| 10% $H_2SO_4$ solution | 144 ml |
| <Solution B> | |
| 2.5N aqueous $AgNO_3$ solution | 3500 ml |
| <Solution C> | |
| Potassium bromide | 1029 g |
| Potassium iodide | 29.3 g |
| Distilled water to make | 3500 ml |

<Solution D>

1.75N aqueous potassium bromide solution in an amounts of controlling silver potential.

At the temperature of 35° C. and using a mixing stirrer as disclosed in Japanese Patent Examined Publications No. 58-58288 (1983) and 58-58289(1983), 64.1 ml of solution B and solution C each were added to solution A over a period of 2 minutes by double-jet method to form silver halide nuclei. Thereafter, the temperature of solution A was raised to 60° C. over a period of 60 minutes.

Then, again solution B and solution C were individually added to solution A by double-jet method for 50 minutes at the flowing rate of 68.5 ml/min.

In the meantime, the silver electrode potential of the solution which was measured using a silver ion selection electrode and a saturated silver-silver chloride electrode as a reference electrode, was controlled at +6 mv by using solution D.

After completion of the addition, PH of the mixed solution was adjusted to 6 using 3% aqueous KOH solution and, immediately thereafter, desalting and washing of the emulsion were conducted.

The emulsion thus obtained is made seed emulsion Em-0. From electron microscopic observation of the emulsion grains, it was found that more than 90% of the total projection area of the silver halide grains contained in this emulsion is accounted for by hexagonal tabular configurations, of which maximum ratio of sides adjacent to each other is in the range of 1.0–2.0, with the average thickness of 0.07 μm, the circle-equivalent diameter of 0.5 μm and the sphere-equivalent diameter of 0.24 μm.

2) Preparation of tabular emulsion

Tabular silver bromoiodide emulsion EM-1 of the present invention containing 1.53 mol % of silver iodide was prepared by using the following solutions given below:

| | |
|---|---|
| <solution A'> | |
| Ossein gelatin | 29.4 g |
| Seed emulsion Em-0 | 0.588 mols equivalent |
| Poly-iso-propylene-polyethyleneoxy-disuccinate sodium salt (10% ethanol solution) | 2.5 ml |
| Distilled water to make | 4800 ml |
| <solution B'> | |
| 3.5N aqueous $AgNO_3$ solution | 2360 ml |
| <solution C'> | |
| Potassium bromide | 968 g |
| Potassium Iodide | 20.6 g |
| Distilled water to make | 2360 mg |
| <solution D'> | |
| 1.75N aqueous KBr solution | |

At the temperature of 60° C. and using the mixing stirrer as disclosed in Japanese Patent Examined Publications No. 58-58288 (1983) and 58-58289 (1983), all of solution B and solution C were added to the reaction vessel containing solution A, at the flow rate of 21.26 ml/min over a period of 111 minutes, by simultaneous double jet method to grow silver halide grains from seed grains.

In the meantime, the silver electrode potential of the solution was maintained at +25 mv by using solution D'. After completion of the addition, 300 mg and 15 mg per mol of silver halide of the following sensitizing dyes (A) and (B) were respectively added.

Sensitizing dye (A): 5,5'-dichloro-9-ethyl-3,3'-di-(3-sulphopropyl) oxacarbocyanine sodium salt anhydrite Sensitizing dye (B): 5,5'-di-(butoxycarbonyl)-1,1'-diethyl-3,3'-di-(4-sulphobutyl)benzimidazolocarbocyanine sodium salt unhydride Next, in order to remove excess salts in the emulsion, the desalinization was conducted using aqueous Demol solution and aqueous magnesium sulfate solution.

To the thus obtained emulsion, aqueous gelatin solution containing 92.2 g of ossein gelatin was added and the emulsion was redispersed.

Approximately 3000 grains of EM-1 were taken out for electron microscopic observation, and the size and shape thereof were analyzed. The results are shown in Table 1.

EXAMPLE 2

Tabular silver iodobromide emulsions EM-2 through EM-8 and EM-15 were prepared in the same manner as in EM-1 of Example 1 except that the amount of distilled water used in solution A' was varied as shown in Table 1.

The analytical results of the shapes of the grains using an electron microscope are shown in Table 1.

EXAMPLE 3

Tabular silver iodobromide emulsions EM-9 through EM-11 were prepared in the same manner as in EM-1 except that the amount of solution A' used and the concentrations of solution B' and solution C' were varied as shown in Table 1.

The analytical results of the shapes of the grains using an electron microscope are shown in Table 1.

EXAMPLE 4

Tabular silver iodobromide emulsions EM-12 through EM-15 were prepared in the same manner as in EM-1 except that the amount of potassium bromide and potassium iodide used in solution C' were varied as shown in Table 1.

The analytical results of the shapes of the grains using an electron microscope, and the average silver iodide content of the emulsions are shown in Table 1.

After adding 140 mg of sensitizing dye (A) and 1.4 mg of sensitizing dye (B) per 1 mol of silver halide to the respective emulsions, $7.0\times10^{-4}$ mols/1 mol of silver of ammonium thiocyanate and an adequate amount of auric chloride and hypo were added to the emulsions to perform chemical ripening. Further, silver iodide fine grain emulsion having the average grain size of 0.06 micron was added. After completion of chemical ripening, the emulsion was stabilized by adding $3\times10^{-2}$ mols of 6-methyl-4-hydroxy-1,3,3a,7-tetrazaindene.

To the emulsion were added the following additives. Added amount is shown in terms of weight per 1 mol of silver halide.

| | |
|---|---|
| t-Butyl catechol | 400 mg |
| Polyvinyl pyrrolidone (molecular weight 10,000) | 1.0 g |
| Styrene-maleic acid anhydride copolymer | 2.5 g |
| Diethylene glycol | 5 g |
| Tri-methylol propane | 10 g |
| Nitrophenyl-tri-phenyl phosphonium chloride | 50 mg |
| Ammonium 1,3-dihydroxybenzene-4-sulfonate | 4 g |
| 2-mercapt-benzimidazole-5-sodium sulphonate | 15 mg |
| $C_4H_9OCH_2CH(OH)CH_2N(CH_2COOH)_2$ | 1 g |
| 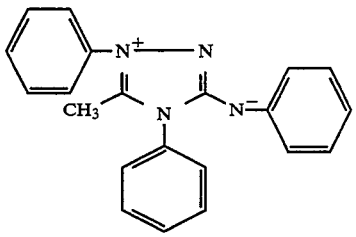 | 150 mg |
| 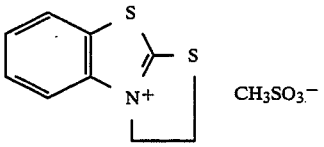 | 70 mg |

Moreover, additives used for the protective layer solution are as follows. Added amount is shown in terms of weight per 1 g gelatin.

| | |
|---|---|
| Matting agent consisting of poly methyl methacrylate having area average grain size of | 7 microns |
| Colloidal silica (average grain size, 0.013 microns) | 70 mg |
| 2,4-di-chloro-6-hydroxy-1,3,5-triazine sodium salt | 30 mg |
| $(CH_2{=}CHSO_2{-}CH_2{-})_2O$ | 36 mg |
| Sodium iso-amyl-n-decylsulpho succinate | 7 mg |
| 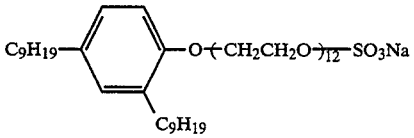 | 12 mg |
| 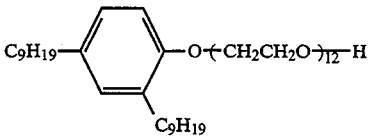 | 2 mg |
| $NaO_3S{-}CH(CH_2COOCH_2(C_2F_4)_3H)COOCH_2(C_2F_4)_3H$ | 5 mg |
| $F_{19}C_9O{-}(CH_2CH_2O)_{10}{-}CH_2CH_2OH$ | 3 mg |
| 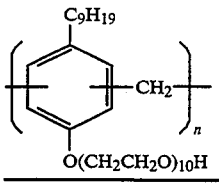 (n = 2 to 5) | 15 mg |

Coating solutions of the above-mentioned were uniformly coated on both surfaces of 180 micron thick polyethyrene terephthalate film with subbing layers and dyed in blue and then, dried to prepare Samples 1 through 13 as shown in Table 2.

Moreover, the amount of gelatin coated on both sides of the film was adjusted so as to be 3.0 g/m$^2$ with respect to the all samples.

Coating weight of silver with respect to each sample has been adjusted to be 2.0 g/m$^2$ on one side.

In Table 1, (2) represents (amounts of solutions B' and C')/(amount of solution A'), and (3) represents the volume concentration of silver halide seed grains contained in solution A'.

Moreover, with respect to EM-14, evaluation of the sample could not be made because of occurrence of coalescence of the grains.

TABLE 1

| Sample No. | Mean grain diameter d (μm) | Mean grain thickness h (μm) | d/h | Average iodide content (mol %) | Amount of solution A' (ml) | Concentrations of solutions B' and C' (N) | (2) | (3) (%) |
|---|---|---|---|---|---|---|---|---|
| EM-1 | 1.05 | 0.25 | 4.2 | 1.53 | 4800 | 3.5 | 0.98 | 0.32 |
| EM-2 | 1.05 | 0.25 | 4.2 | 1.53 | 4000 | 3.5 | 1.18 | 0.38 |
| EM-3 | 1.03 | 0.26 | 4.0 | 1.53 | 3000 | 3.5 | 1.57 | 0.51 |
| EM-4 | 1.05 | 0.25 | 4.2 | 1.53 | 2000 | 3.5 | 2.35 | 0.76 |
| EM-5 | 1.03 | 0.26 | 4.0 | 1.53 | 1000 | 3.5 | 4.70 | 1.52 |
| EM-6 | 1.03 | 0.26 | 4.0 | 1.53 | 500 | 3.5 | 9.40 | 3.05 |
| EM-7 | 1.03 | 0.26 | 4.0 | 1.53 | 300 | 3.5 | 15.7 | 5.08 |
| EM-8 | 1.01 | 0.27 | 3.7 | 1.53 | 250 | 3.5 | 18.8 | 6.10 |
| EM-9 | 1.05 | 0.25 | 4.2 | 1.53 | 4000 | 1.7 | 2.42 | 0.38 |
| EM-10 | 1.05 | 0.25 | 4.2 | 1.53 | 3000 | 1.7 | 3.23 | 0.51 |
| EM-11 | 1.05 | 0.25 | 4.2 | 1.53 | 2000 | 1.7 | 4.85 | 0.76 |
| EM-12 | 1.07 | 0.24 | 4.5 | 0.59 | 1000 | 3.5 | 4.70 | 1.52 |
| EM-13 | 1.05 | 0.25 | 4.2 | 2.47 | 1000 | 3.5 | 4.70 | 1.52 |
| EM-14 | | Coalescence | | 4.82 | 1000 | 3.5 | 4.70 | 1.52 |
| EM-15 | 1.03 | 0.26 | 4.0 | 1.53 | 400 | 3.5 | 11.80 | 3.80 |

Evaluation of Sensitivity

The thus obtained samples were respectively held between a pair of intensifying screens KO-250 for X-ray photography and exposed to X-ray irradiation through a Penetrol Meter Type-B.

Then the samples were processed with automatic processor SRX-501 (Product of Konica Corporation.) and using XD-SR processing solutions (Product of Konica Corporation) at 35° C. for 45 seconds.

Then sensitivity of each samples processed as above was evaluated: .

Sensitivity was given with a relative value when the reciprocal of the amount of the irradiation energy which requires to give density of fog +1.0 in Sample No. 1 was normalized as 100.

Evaluation of Pressure Mark

After leaving the respective 13 mm×35 mm size samples at a temperature of 23° C. and the relative humidity of 42% over a period of one hour, they were respectively folded at the curvature radius of 4 mm under the same atmospheric conditions.

The density difference (dD) between the density in the blackening part caused by pressure due to folding the sample and the fog density was assumed to be a measure of pressure mark. That is, the smaller the dD, the better anti-pressure mark characteristic is.

Evaluation of Graininess

The sample was overall-uniformly exposed to light on one side and a following five step evaluation was made by visual observation using process samples of 20 cm×20 cm size in the area of which density is 0.6–0.8.

5: Excellent.
4: Good.
3: Practically acceptable.
2: Grainy though practically acceptable.
1: Too grainy for practical use.

The results are shown in Table 2.

TABLE 2

| Sample No. | Emulsion No. | Fog | Sensitivity | Pressure mark | Graininess | Remarks |
|---|---|---|---|---|---|---|
| 1 | EM-1 | 0.08 | 100 | 0.2 | 1 | Comp. |
| 2 | EM-2 | 0.07 | 100 | 0.17 | 1 | Comp. |
| 3 | EM-3 | 0.07 | 105 | 0.15 | 2 | Comp. |
| 4 | EM-4 | 0.01 | 140 | 0.05 | 5 | Inv. |
| 5 | EM-5 | 0.02 | 145 | 0.05 | 5 | Inv. |
| 6 | EM-6 | 0.03 | 138 | 0.06 | 4 | Inv. |
| 7 | EM-7 | 0.07 | 95 | 0.15 | 3 | Comp. |
| 8 | EM-8 | 0.07 | 67 | 0.22 | 2 | Comp. |
| 9 | EM-9 | 0.08 | 88 | 0.21 | 2 | Comp. |
| 10 | EM-10 | 0.03 | 130 | 0.05 | 4 | Inv. |
| 11 | EM-11 | 0.02 | 127 | 0.04 | 5 | Inv. |
| 12 | EM-12 | 0.02 | 130 | 0.04 | 4 | Inv. |
| 13 | EM-13 | 0.04 | 98 | 0.24 | 1 | Comp. |
| 14 | EM-14 | — | — | — | — | Comp. |
| 15 | EM-15 | 0.05 | 110 | 0.11 | 3 | Comp. |

It is apparent from Table 2 that the present invention leads to remarkable improvements in pressure mark. And, it is also shown that silver halide photographic light-sensitive materials of the invention has achieved high sensitivity, low fog and excellent graininess.

What is claimed is:

1. A method for preparing a silver iodobromide emulsion comprising silver iodobromide grains containing an average silver iodide content of 2 mol % or less comprising silver idobromide grains containing an average silver iodide content of 2 mol % or less comprising (i) preparing a seed emulsion containing silver halide seed grains, (ii) introducing the seed emulsion into a reaction vessel having a hydrophilic colloid solution and (iii) further incorporating simultaneously a solution of a silver salt and a solution of bromide and iodide salts into the reaction vessel having the hydrophilic colloid solution containing said seed grains to form the silver iodobromide grains, wherein in the step (iii), the total volume of said solutions of the silver salt, and the bromide and iodide salts is within a range of 2 to 10 times the volume of the hydrophilic colloid solution containing said seed grains; and said seed grains have an average size of 0.3 μm or less and are contained in an amount of 0.5 to 5.0% by volume in the hydrophilic colloid solution.

2. The method of claim 1, wherein said silver iodobromide emulsion comprises silver iodobromide tabular grains having an average thickness of 0.3 μm or less and an average aspect ratio of grain diameter to thickness of 2 or more, and accounting for at least 50% of the total projected area of said silver iodobromide grains.

3. The method of claim 2, wherein said seed grains have an average thickness of 0.1 to 0.3 μm.

4. The method of claim 3, wherein said thickness is 0.1 to 0.25 μm.

5. The method of claim 3, wherein the seed grains are contained in an amount of 0.6 to 3% by volume.

6. The method of claim 1, wherein said seed grains have an average grain size of 0.1 to 0.3 μm in sphere equivalent diameter.

7. The method of claim 6, wherein the seed grains are contained in an amount of 0.6 to 3% by volume.

8. The method of claim 7, wherein said size is 0.1 to 0.25 μm.

9. The method of claim 6, wherein said size is 0.1 to 0.25 μm.

10. The method of claim 1, wherein the total volume of said solutions of the silver salt and the bromide and iodide salts is within a range of 2 to 5 times the volume of the hydrophilic colloid solution containing said seed grains.

11. The method of claim 1, wherein said silver iodobromide emulsion is monodispersed emulsion having a distribution width of 20% or less.

12. The method of claim 1, wherein said seed grains have an average grain size of 0.1 to 0.3 μm in sphere equivalent diameter;

the total volume of said solutions of the silver salt and the bromide and iodide salts is within a range of 2 to 5 times the volume of the hydrophilic colloid solution containing said seed grains; and said silver idobromide emulsion is monodispersed emulsion having a distribution width of 20% or less.

13. The method of claim 12, wherein the seed grains are contained in an amount of 0.6 to 3% by volume.

14. The method of claim 13, wherein said size is 0.1 to 0.25 μm.

* * * * *